US009175813B2

(12) United States Patent
DeVore et al.

(10) Patent No.: US 9,175,813 B2
(45) Date of Patent: Nov. 3, 2015

(54) ELECTRICAL CONNECTORS FOR SOLID STATE LIGHT

(75) Inventors: Charles N. DeVore, Hugo, MN (US); Kayla A. Hagens, Cottage Grove, MN (US); Wesley A. Raider, Hudson, WI (US); Larry A. Schleif, Monticello, MN (US); Steven Feldman, Cedar Park, TX (US); Steven A. Neu, Cedar Park, TX (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 860 days.

(21) Appl. No.: 13/435,224

(22) Filed: Mar. 30, 2012

(65) Prior Publication Data

US 2013/0257278 A1 Oct. 3, 2013

(51) Int. Cl.

| | |
|---|---|
| ***H01J 7/24*** | (2006.01) |
| ***F21K 99/00*** | (2010.01) |
| ***H01J 5/54*** | (2006.01) |
| ***F21V 23/00*** | (2015.01) |
| *F21V 3/02* | (2006.01) |
| *F21Y 101/02* | (2006.01) |
| *F21Y 103/02* | (2006.01) |
| *F21V 29/506* | (2015.01) |

(52) U.S. Cl.

CPC ..... *F21K 9/1355* (2013.01); *F21K 9/52* (2013.01); *F21V 23/006* (2013.01); *H01J 5/54* (2013.01); *F21V 3/02* (2013.01); *F21V 29/506* (2013.01); *F21Y 2101/02* (2013.01); *F21Y 2103/022* (2013.01)

(58) Field of Classification Search

CPC .. F21Y 2101/02; C08L 2666/02; C08L 67/04
See application file for complete search history.

(56) References Cited

U.S. PATENT DOCUMENTS

| | | | | |
|---|---|---|---|---|
| D642,704 | S | 8/2011 | Hagens | |
| 2004/0037087 | A1 | 2/2004 | Desai | |
| 2007/0296350 | A1 | 12/2007 | Maxi | |
| 2009/0175041 | A1 | 7/2009 | Yuen | |
| 2011/0032708 | A1 | 2/2011 | Johnston | |
| 2011/0309735 | A1 | 12/2011 | Parker | |
| 2012/0020108 | A1 * | 1/2012 | Chang | 362/555 |
| 2012/0044692 | A1 | 2/2012 | Liang et al. | |
| 2012/0139403 | A1 | 6/2012 | Johnston et al. | |
| 2012/0243230 | A1 * | 9/2012 | Carroll et al. | 362/249.02 |

FOREIGN PATENT DOCUMENTS

| | | |
|---|---|---|
| JP | 2012009390 | 1/2012 |
| KR | 101035951 | 5/2011 |
| KR | 101045457 | 7/2011 |

* cited by examiner

*Primary Examiner* — Sibin Chen

(57) ABSTRACT

A light having integrated light and thermal guides and separable electrical connectors. The light has a base for connection to a power supply, a light circuit electrically connected with solid state light sources such as LEDs, and a driver circuit for receiving power from the power supply and providing power to drive the light sources. A light guide is coupled to the light sources for receiving and distributing light from the light sources, and a thermal guide is integrated with the light guide for providing thermal conduction from the light source for cooling the light. The separable connectors include a first connector for providing an electrical connection between the driver circuit and light circuit, a second connector for providing an electrical connection between the power supply and driver circuit, and a third connector for providing a ground connection to the driver circuit.

20 Claims, 7 Drawing Sheets

ELECTRICAL CONNECTORS FOR SOLID STATE LIGHT

BACKGROUND

Solid state lights, such as those using light emitting diodes (LEDs), are an alternative to incandescent light bulbs. LED lights can provide for more efficient energy use compared with incandescent light bulbs. The assembly of an LED light bulb can require hand soldering operations for various electrical connections, which is a time consuming and expensive process. Accordingly, a need exists for improved electrical connectors for LED lights and other solid state lights.

SUMMARY

A light, consistent with the present invention, includes integrated light and thermal guides and separable electrical connectors. The light has a base for connection to a power supply, a light circuit electrically connected with at least one solid state light source, and a driver circuit for receiving power from the power supply and providing power to drive the solid state light source. A light guide is coupled to the solid state light source for receiving and distributing light from the light source by transporting the light until it is extracted from a surface of the light guide. A thermal guide is integrated with the light guide for providing thermal conduction from the light source for cooling the light. The separable connectors include a first connector for providing an electrical connection between the driver circuit and light circuit, and a second connector for providing an electrical connection between the power supply and driver circuit.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

This connector scheme provides electrical connections from the driver circuit of a light to power a circuit with LEDs or other solid state light sources on it. The scheme also provides connections from the driver circuit to the base of the light for the high-voltage side connection. In both of these cases, the design allows for the electrical connections to be made without the use of hand-soldered wires, for example.

Solid State Light

Figure 1:
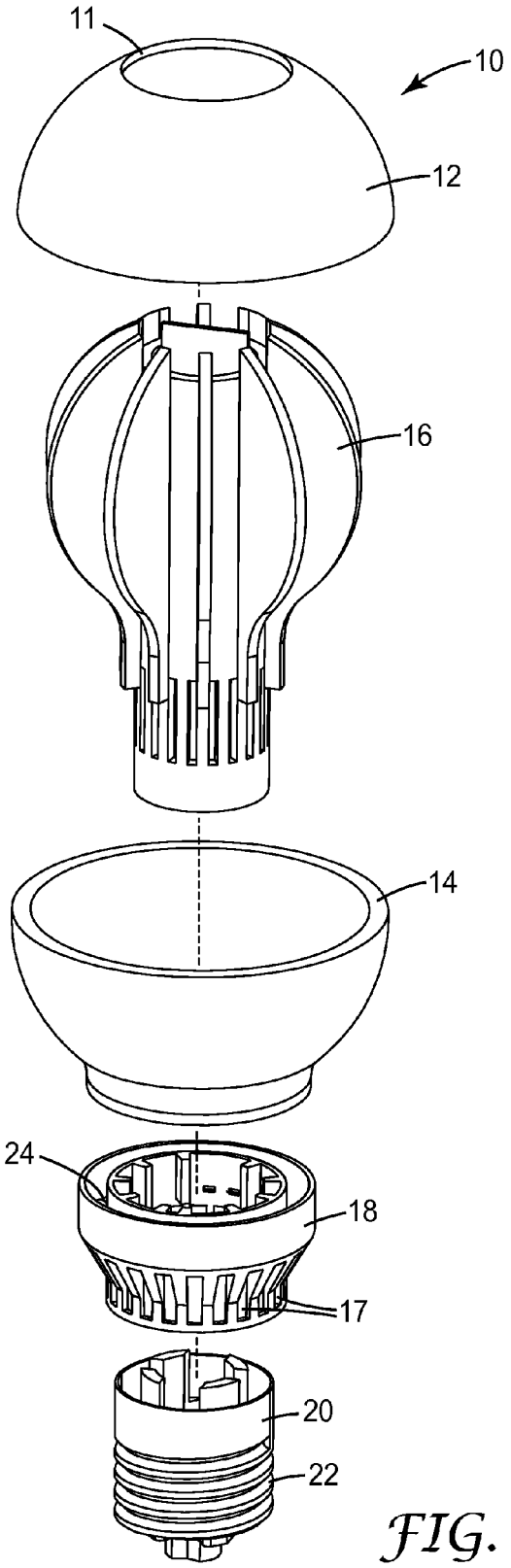
FIG. 1 is an exploded perspective view of an LED light with a light guide and thermal guide.
Figure 2:
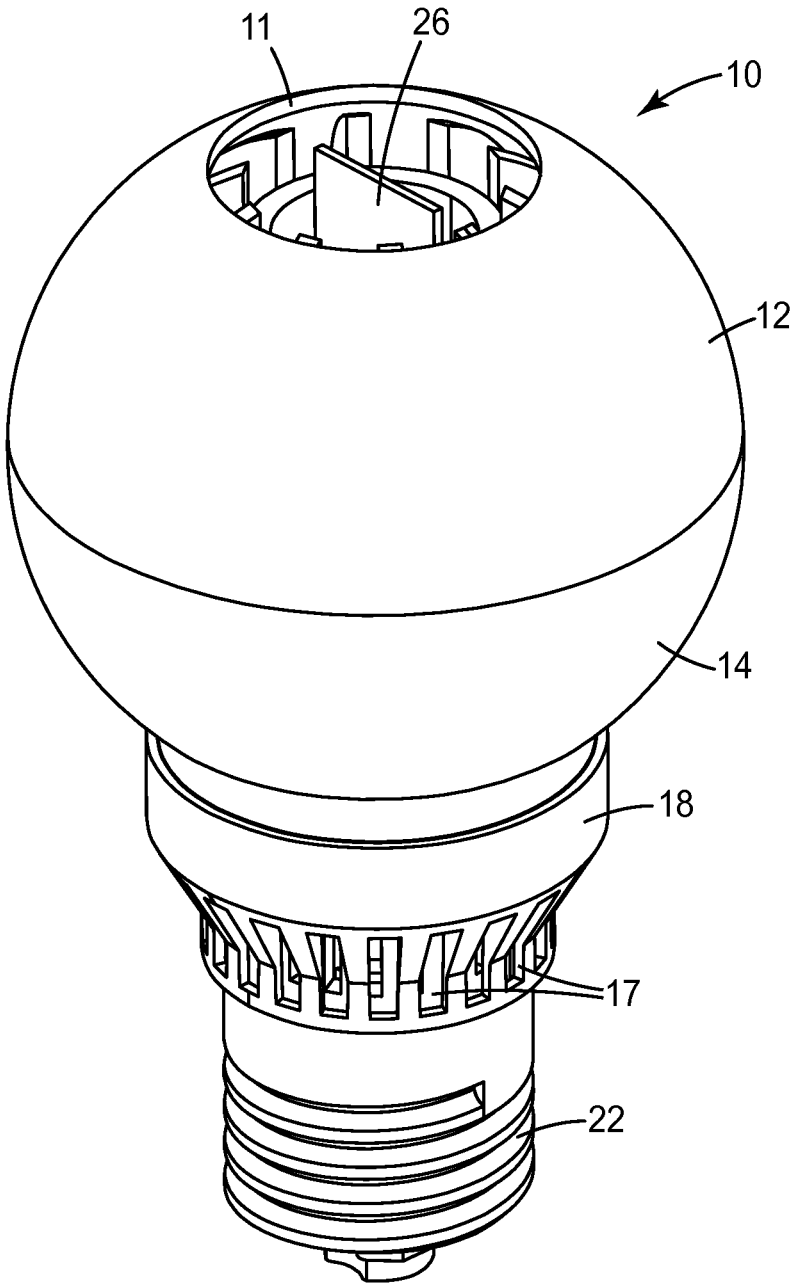
FIG. 2 is a perspective view of the light of FIG. 1 as assembled.

FIG. 1 is an exploded perspective view of a solid state light 10. FIG. 2 is a perspective view of light 10 as assembled. The perspective view in FIG. 2 is looking at the side and top of light 10, which is generally symmetrical from a side view. Light 10 includes a light guide comprised of upper and lower portions 12 and 14, an integrated thermal guide 16, a decorative light ring 18 containing a light circuit 24 having solid state light sources 25 (see FIGS. 4 and 6), a base portion 20, and a base 22 for electrical connection to a power source such as via conventional light sockets. Base 22 can be implemented with an Edison base to be secured within a corresponding light socket, and base portion 20 can be implemented with an insulator in contact with base 22. Although the light guide is shown as having two portions, it can alternatively have more than two portions or be composed of a single continuous piece of material. Also, the light guide can be configured to form an interior volume, such as by having a bulb shape as shown.

Figure 4:
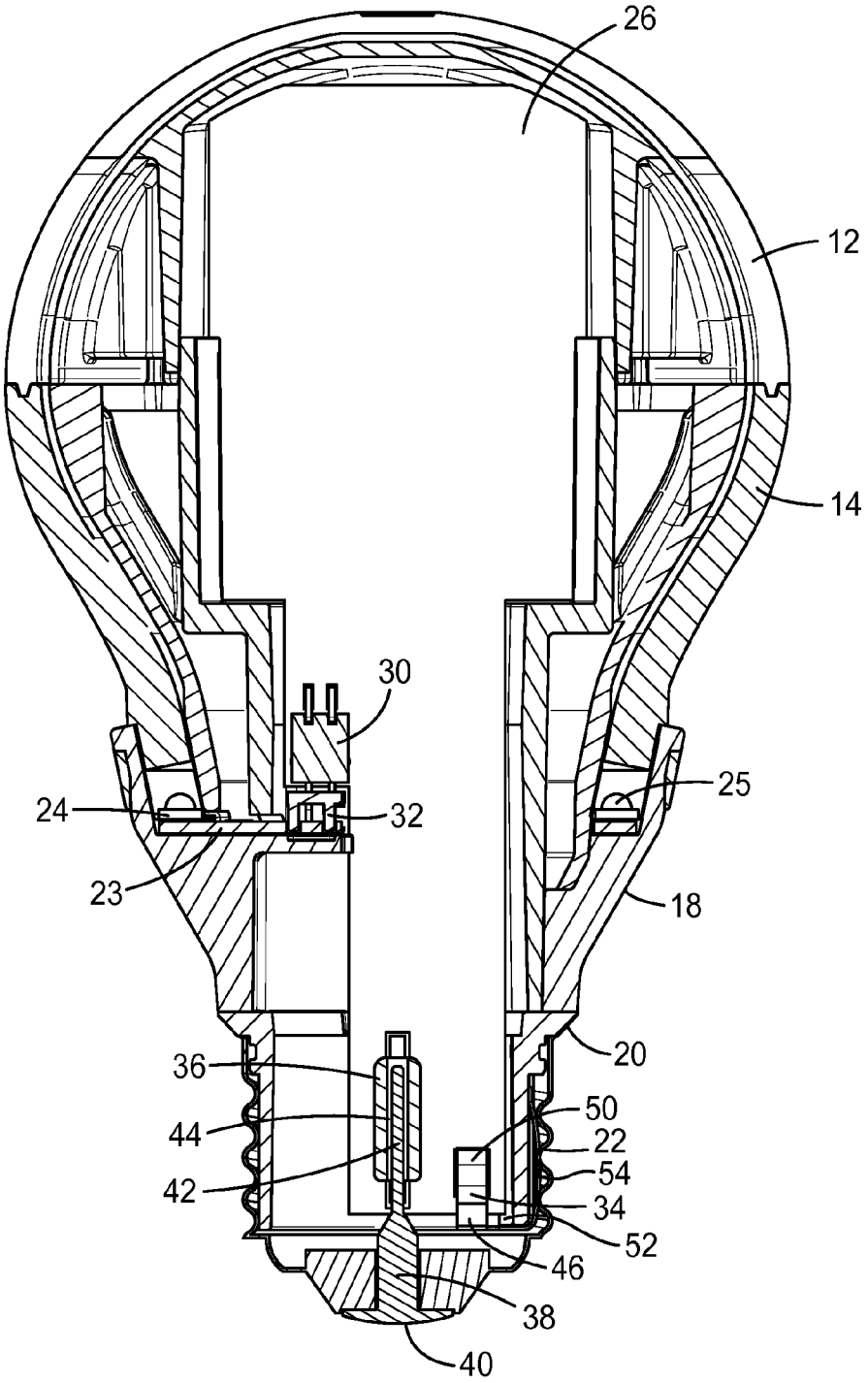
FIG. 4 is a side sectional view of components within the LED light including the electrical connectors when connected.

As illustrated in FIG. 2, upper portion 12 mates with lower portion 14 to form the light guide, and lower portion 14 mounts to light ring 18 in order to optically couple with solid state light sources on light circuit 24. Thermal guide 16 connects with light ring 18 and base portion 20 in order to draw and dissipate heat from the solid state light sources. As shown in FIG. 1, thermal guide 16 has a central core connected with external metal fins, which can conform to the shape of the light guide and be located at least partially within the interior volume formed by the light guide. Alternatively as illustrated in FIG. 4, the thermal guide can have an exterior shell conforming to the shape of the light guide along with an internal core that fits within the shell. Internal metal fins can be located on an inside of the exterior shell, on the internal core, or on both the shell and core. The exterior shell can be composed of one piece of material or multiple pieces, and the external shell houses the fins such that the fins are not visible through the light guide. As shown in FIGS. 1 and 2, an air passage 11 in upper portion 12 along with apertures 17 in light ring 18 allow air flow across thermal guide 16

A driver circuit 26, on a printed circuit board or flexible circuit, is mounted in the central core of thermal guide 16 such as within a slot in the thermal guide (see FIG. 4). When mounted, driver circuit 26 is electrically connected with solid state light sources on light circuit 24 and base 22. Driver circuit 26 receives power from a power supply, typically a high voltage AC power source, via base 22 and provides the required voltages and currents to drive the solid state light sources. Driver circuit 26 can be thermally coupled to the thermal guide in order to help cool the electronic components.

Examples of solid state lights, including lights using LEDs, are described in U.S. Patent Application Publication No. 2011/0032708 and U.S. patent application Ser. No. 12/960,642, entitled "Solid State Light with Light guide and Integrated Thermal Guide," and filed Dec. 6, 2010, both of which are incorporated herein by reference as if fully set forth.

Connector Scheme for Solid State Light

Figure 3:
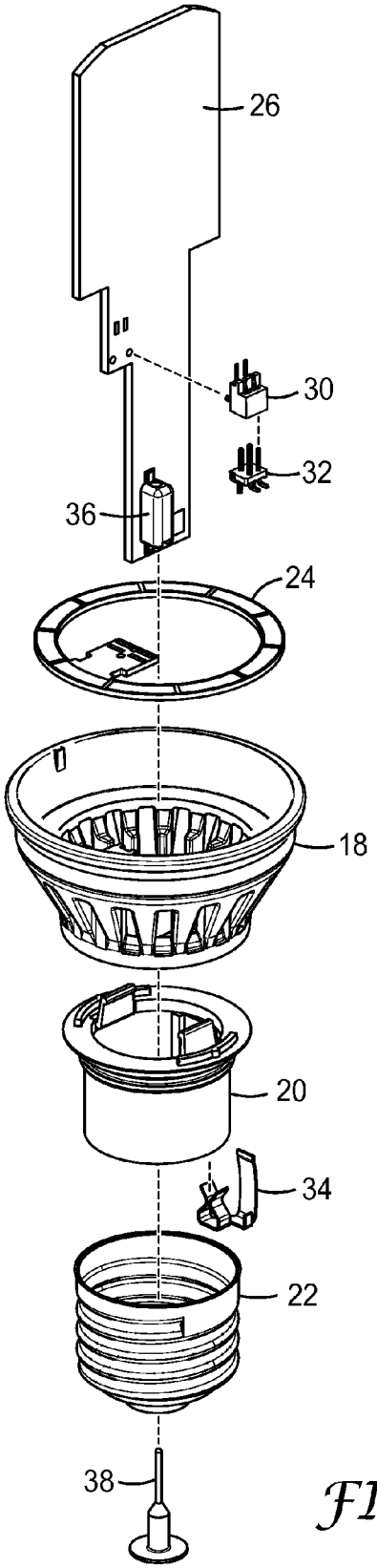
FIG. 3 is an exploded perspective view illustrating components within the LED light including three electrical connectors.

FIG. 3 is an exploded perspective view illustrating components within the LED light, including first, second, and third separable connectors. A first separable connector includes a socket connector 30 that mates with a header connector 32 in order to provide an electrical connection between driver circuit 26 and light circuit 24. A second separable connector includes a poke-in connector 36 that mates with a pin connector 38. The second connector receives power from the power source via pin 38 when the light is secured within a socket and delivers the power to driver circuit 26 via poke-in connector 36. A third separable connector includes a neutral clip 34, which provides for an electrical ground connection between driver circuit 26 and base 22.

The first, second, and third connectors are separable in the sense they can be connected and disconnected without damaging them or while otherwise maintaining their components substantially intact such that they can be reconnected. In some cases, a connector can be made non-releasable when in the light while still being separable from its mating connector. In comparison, a hard wired or soldered connection requires the connection to be broken in order to disconnect it and then resoldered in order to reconnect it. Since the electrical connectors of the present invention are separable, the light can be, for example, more easily assembled for operation or disconnected for servicing or replacement of particular components of it.

Figure 5:
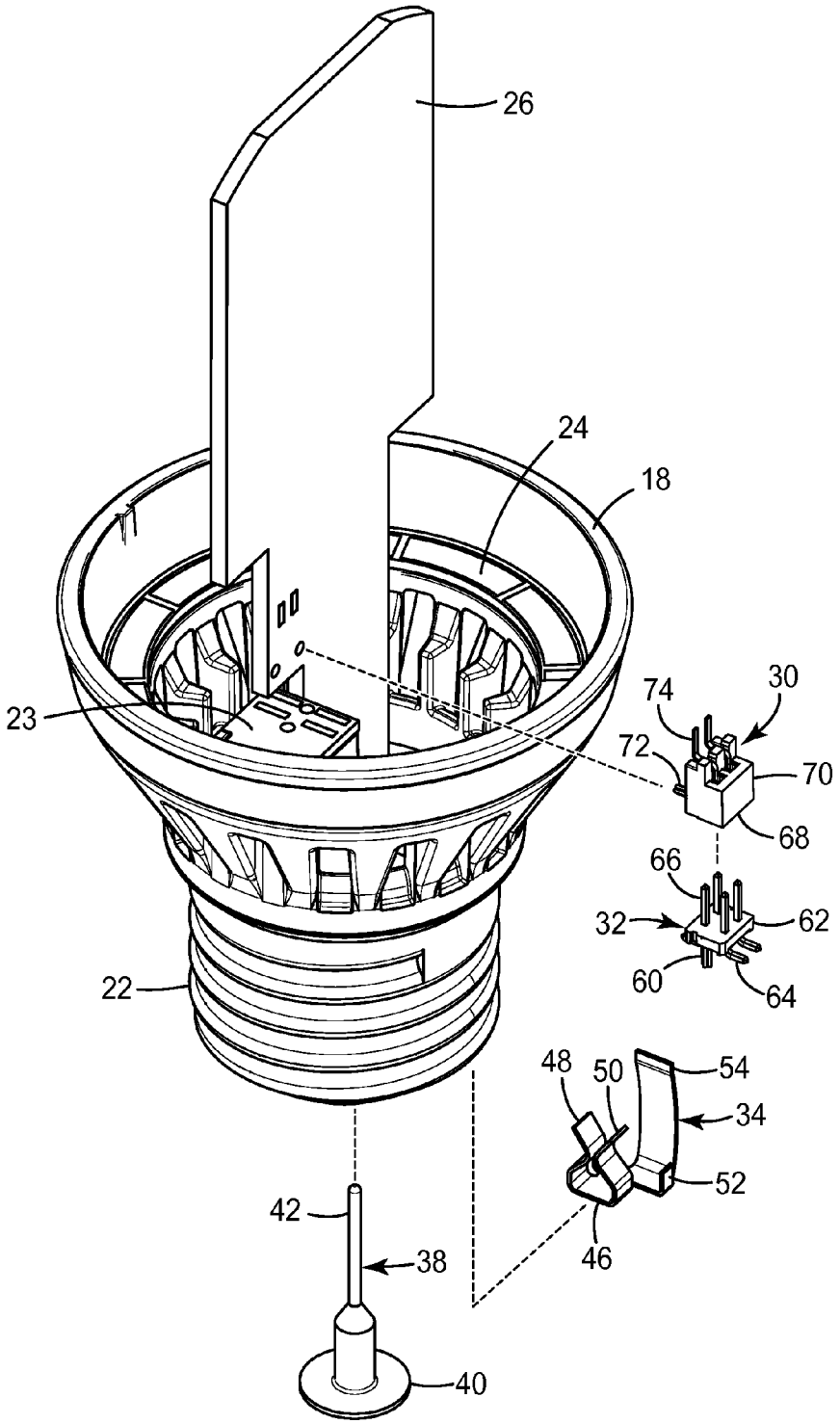
FIG. 5 is an exploded perspective view illustrating the electrical connectors when disconnected.
Figure 6:
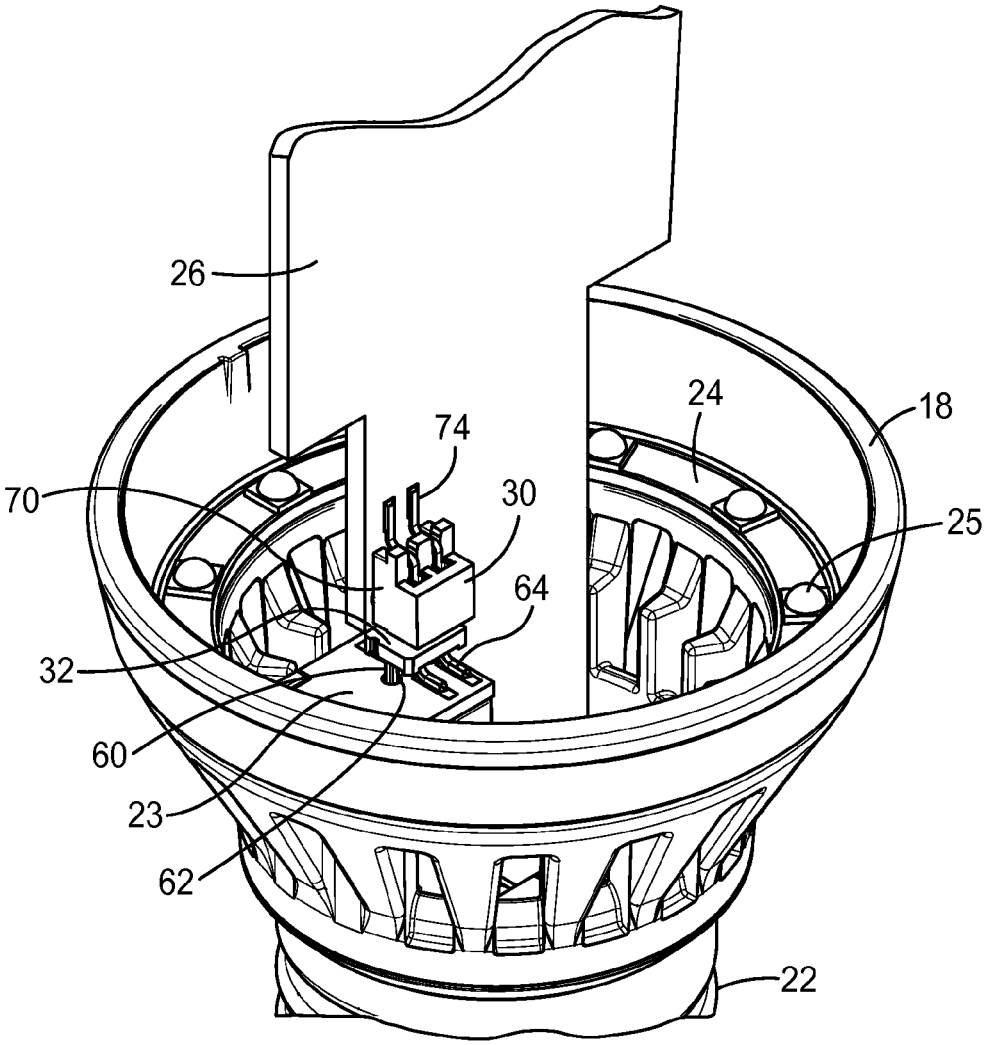
FIG. 6 is a perspective view illustrating the first electrical connector when connected.
Figure 7:
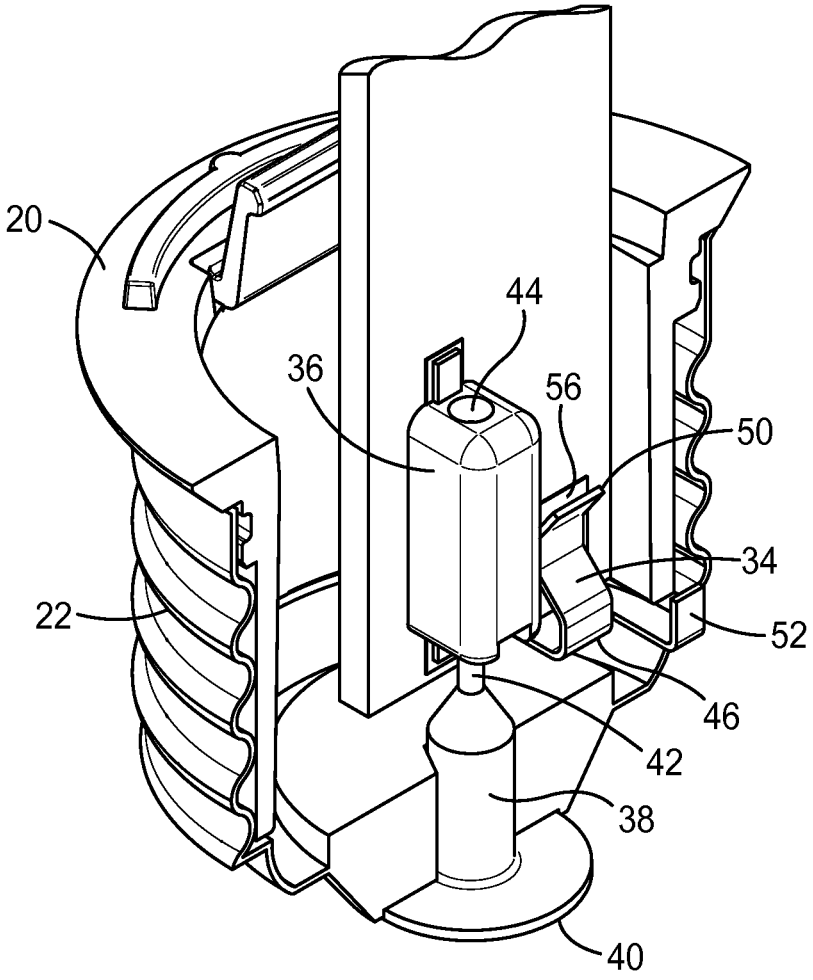
FIG. 7 is a perspective view illustrating the second and third electrical connectors when connected.

FIGS. 4-7 illustrate details of the electrical connectors. FIG. 4 is a side sectional view illustrating the connectors when connected. FIG. 5 is a perspective view illustrating the connectors when disconnected. FIG. 6 is a perspective view illustrating the first connector (socket and header connector) when connected. FIG. 7 is a perspective view illustrating the second connector (poke-in connector and pin) and third connector (neutral clip) when connected.

As shown in FIGS. 4-6, the first connector includes socket connector 30 and header connector 32. Socket connector 30 includes a section 70 having a plurality of apertures 68 on its underside, a plurality of conductive strips 74, and a pin 72. Header connector 32 includes a section 62 having a plurality of pins 66, conductive strips 64 and a pin 60. When connected (see FIGS. 4 and 6), socket connector is mounted to driver circuit 26 via pin 72, and conductive strips 74 are in electrical contact with conductive elements on driver circuit 26 in order to provide an electrical connection between the first connector and driver circuit 26. Header connector is mounted to a section 23 via pin 60. Section 23 is part of light circuit 24. Conductive strips 64 are in electrical contact with conductive elements on section 23 in order to provide an electrical connection between the first connector and light circuit 24, which transmits power to the LEDS. Pins 66 on header connector 32 mate with apertures 68 on socket connector 30 in order to establish an electrical connection between header connector 32 and socket connector 30. In this embodiment, pins 66 include a set of electrically conductive pins for transmitting power and a set of non-electrically conductive (registration) pins for correctly aligning header connector 32 with socket connector 30. Likewise, apertures 68 in socket connector 30 include a corresponding set of electrically conductive apertures and set of non-electrically conductive apertures.

When connected, socket connector 30 and header connector 32 provide the low-voltage connection from driver circuit 26 to light circuit 24. When driver circuit 26 is installed in the light, socket connector 30 mates with header connector 32. Conversely, if driver circuit 26 is removed from the light, socket 30 connector can be releasably detached from header connector 32.

As shown in FIGS. 4, 5, and 7, the second connector includes poke-in connector 36 that mates with a pin connector 38. Poke-in connector 36 is attached to driver circuit 26 and provides and electrical connection with driver circuit 26 via a conductive aperture 44. Pin connector 38 includes a base 40 and a pin section 42. When connected (see FIGS. 4 and 7), pin section 42 mates with conductive aperture 44 and established an electrical connection between base 40 and driver circuit 26. When the light is installed within a light socket or other fixture, base 40 is in electrical contact with a power source, and transmits the power to driver circuit 26 via the connection between poke-in connector 36 and pin connector 38. During assembly of the light, pin connector 38 is inserted into poke-in connector 36 on the driver circuit 26.

As shown in FIGS. 4, 5, and 7, the third connector includes neutral clip 34 for providing a ground connection for the light. Neutral clip 34 includes a clip portion formed by a base 46 and tabs 48 and 50, a section 52, and a spring-like finger 54. When connected (see FIGS. 4, and 7), clip portion clamps onto and is in contact with driver circuit 26 and provides an electrical connection with driver circuit 26 via tabs 48 and 50 being in contact with conductive neutral pad 56 on driver circuit 26. Section 52 is releasably secured to a bottom edge of insulator 20, and spring-like finger 54 fits into a slot on insulator 20 and is in electrical contact with base 22 in order to provide the ground connection between driver circuit 26 and base 22 when inserted into a socket or other fixture. During assembly, when driver circuit 26 is inserted into base 22, neutral clip 34 connects to neutral pads 56 on the driver circuit 26.

In this embodiment, light circuit 24 is physically separable from driver circuit 26 via disconnection of socket connector 30 from header connector 32. Having the LEDs on a separate circuit from the driver circuit can provide for connection of the circuits via a separable connector and other advantages. The same driver circuit can be used with different light circuits such as light circuits having different colored LEDs to provide for different color lights. The driver circuit can be electrically connected to the light circuit in an automated assembly process. Furthermore as illustrated in FIG. 4, the slot on the thermal guide to contain the driver circuit on a circuit board can guide the circuit board contact pad and connectors into alignment with all three mating connectors so that the light assembly can be "blind mated."

The following are exemplary components and materials for the first, second, and third connectors. Socket connector 30 can include a plastic material for section 70 and pin 72, apertures formed in the plastic material for the non-electrically conductive apertures, a metallic material such as copper for conductive strips 74, and a metallic material for the electrically conductive apertures connected to conductive strips 74. Header connector 32 can includes a plastic material for section 62 and pin 60, the non-electrically conductive pins formed from the plastic material, a metallic material such as copper for conductive strips 64, and a metallic material for the electrically conductive pins connected to conductive strips 64. Poke-in connector 36 can be implemented with, for example, LED poke-in product number 2008563-1 from Tyco Electronics Corporation. Pin connector 38 can be implemented with a unitary metal pin. Neutral clip 34 can be implemented with a stamped and formed metal spring clip.

The first, second, and third connectors can alternatively be implemented with other types of materials. The components of the connectors can include single unitary components or a combination of sub-components combined to form the components. Although the various pins are shown as having a round shape, the pins can be square or have other types of shapes.

The invention claimed is:

1. A light with integrated light and thermal guides and separable electrical connectors, comprising:

a base for connection to a power supply;

a light circuit electrically connected with at least one light source;

a driver circuit for receiving power from the power supply and providing power to drive the light source;

a light guide coupled to the light source for receiving and distributing light from the light source, wherein the light is transported through the light guide until the light is extracted from a surface of the light guide;

a thermal guide integrated with the light guide for providing thermal conduction from the light source for cooling the light a first separable connector for providing an electrical connection between the driver circuit and the light circuit; and a second separable connector for providing an electrical connection between the power supply and the driver circuit.

2. The light of claim 1, wherein the first connector comprises a socket connector that mates with a header connector.

3. The light of claim 2, wherein the header connector comprises a first set of electrically conductive pins and a second set of non-electrically conductive pins, wherein the socket connector includes a first set of electrically conductive apertures that mate with the first set of electrically conductive pins and a second set of non-electrically conductive apertures that mate with the second set of non-electrically conductive pins.

4. The light of claim 1, wherein the second connector comprises a poke-in connector that mates with a pin connector.

5. The light of claim 1, further comprising a third connector for providing an electrical ground connection between the driver circuit and the base.

6. The light of claim 5, wherein the third connector comprises an electrically conductive clip.

7. The light of claim 1, wherein the light source comprises at least one light emitting diode.

8. The light of claim 1, wherein the light circuit is physically separable from the driver circuit via disconnection of the first separable connector.

9. The light of claim 1, wherein the thermal guide includes a slot for containing the driver circuit.

10. A light with integrated light and thermal guides and separable electrical connectors, comprising:

a base for connection to a power supply;

a light circuit electrically connected with at least one solid state light source;

a driver circuit for receiving power from the power supply and providing power to drive the solid state light source;

a light guide comprising a material having a first surface and a second surface opposite the first surface, wherein the second surface forms an interior volume, the light guide is coupled to the solid state light source for receiving and distributing light from the solid state light source through the first surface, and the light is transported through the light guide until the light is extracted from the first or second surface of the light guide;

a thermal guide as least partially contained within the interior volume and integrated with the light guide for providing thermal conduction from the solid state light source for cooling the light;

a first separable connector for providing an electrical connection between the driver circuit and the light circuit; and a second separable connector for providing an electrical connection between the power supply and the driver circuit.

11. The light of claim 10, wherein the first connector comprises a socket connector that mates with a header connector.

12. The light of claim 11, wherein the header connector comprises a first set of electrically conductive pins and a second set of non-electrically conductive pins, wherein the socket connector includes a first set of electrically conductive apertures that mate with the first set of electrically conductive pins and a second set of non-electrically conductive apertures that mate with the second set of non-electrically conductive pins.

13. The light of claim 10, wherein the second connector comprises a poke-in connector that mates with a pin connector.

14. The light of claim 10, further comprising a third connector for providing an electrical ground connection between the driver circuit and the base.

15. The light of claim 14, wherein the third connector comprises an electrically conductive clip.

16. The light of claim 10, wherein the light circuit is physically separable from the driver circuit via disconnection of the first separable connector.

17. The light of claim 10, wherein the light source comprises a light emitting diode.

18. The light of claim 10, wherein the thermal guide comprises metal fins.

19. The light of claim 10, wherein the light guide comprises a bulb shape.

20. The light of claim 10, wherein the thermal guide includes a slot for containing the driver circuit.

* * * * *